United States Patent [19]

Unger

[11] 4,363,016

[45] Dec. 7, 1982

[54] CIRCUIT BREAKER

[75] Inventor: Robert P. Unger, Evansville, Ind.

[73] Assignee: AMF Incorporated, White Plains, N.Y.

[21] Appl. No.: 270,186

[22] Filed: Jun. 3, 1981

[51] Int. Cl.[3] ..... H01H 71/58

[52] U.S. Cl. ..... 337/56; 337/91

[58] Field of Search ..... 337/56, 66, 68, 72, 337/85, 91; 200/153 M

[56] References Cited

U.S. PATENT DOCUMENTS 3,257,523 6/1966 Clarke ..... 335/191

4,068,203 1/1978 Unger ..... 337/91

*Primary Examiner*—Harold Broome

*Attorney, Agent, or Firm*—David E. Dougherty; Charles J. Worth

[57] ABSTRACT

A circuit breaker with an electrical insulator slide interposable between two generally convex contacts thereof and a rocker button rotatably trap mounted on a protrusion extending from the inside wall of the case which interacts wtih pivot points at one end of the slide to translate the rocking motion of the button into a linear motion displacement of the slide. The slide includes generally parallel elongate spaced apart standoff protrusions adapted to maintain the operating electrical contact surface of the movable contact withdrawn from contact with the slide when in the tripped position and during a resetting of the circuit breaker. The slide also includes a contoured portion adapted to generally mate with curved portions of but be visually distinguishable from the rocker button to present a readily discernable indication that the circuit breaker is in the tripped condition.

14 Claims, 16 Drawing Figures

FIG. 6
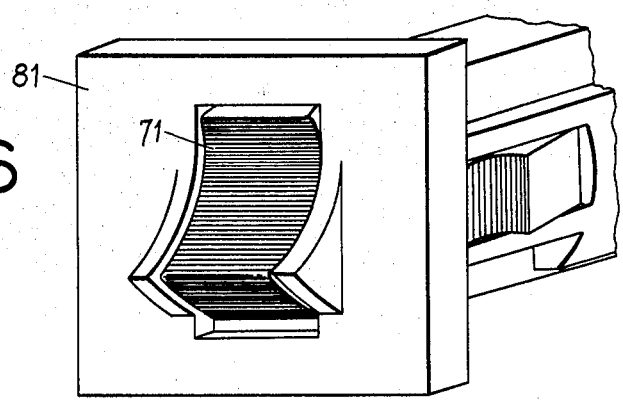
FIG. 7
FIG. 10
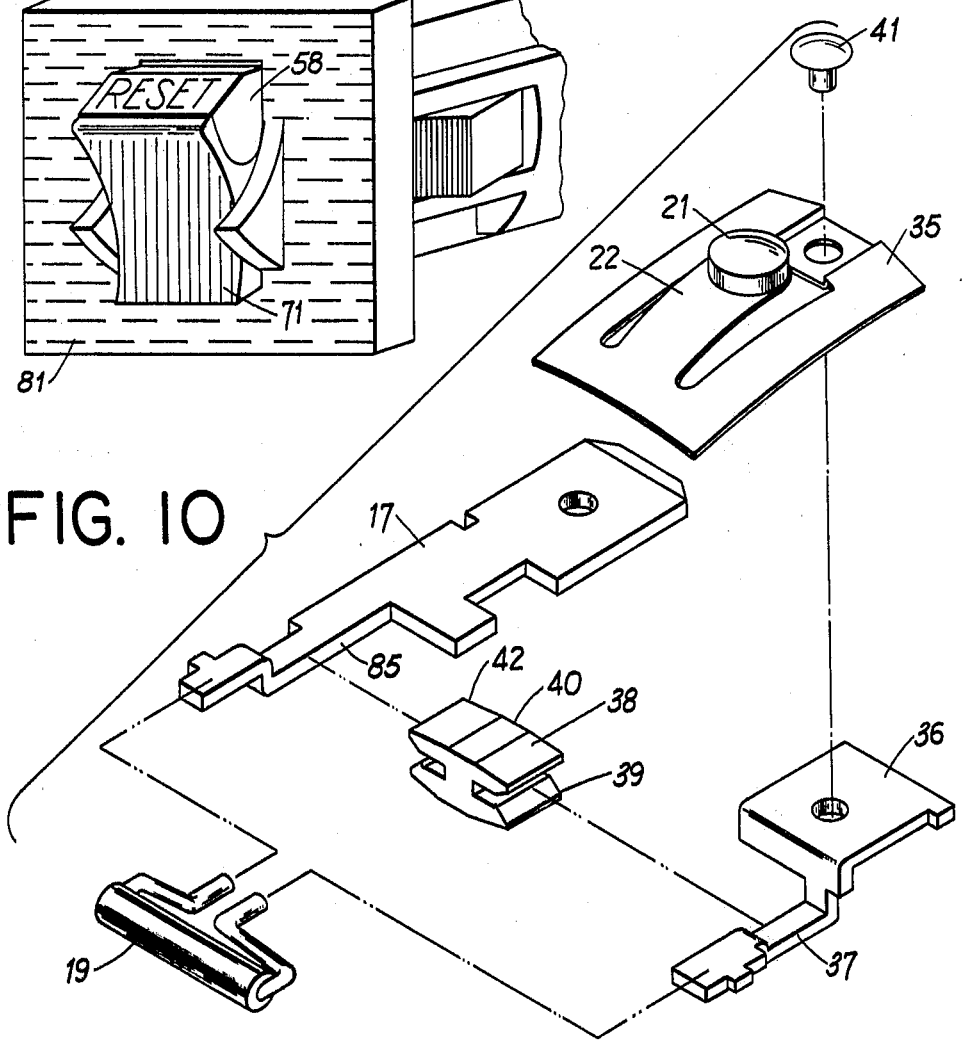

CIRCUIT BREAKER

BACKGROUND OF THE INVENTION

This invention relates to switches and electric circuit breakers, for example, of the bimetallic type and, more particularly, to circuit breakers which are automatically operable in response to a predetermined abnormal current condition in the circuit.

PRIOR ART STATEMENT

It is typical in the prior art for thermal type circuit breakers to include a slide member longitudinally translated by means of a push button actuator such as is described in U.S. Pat. No. 4,068,203 issued Jan. 10, 1978 to Robert P. Unger.

Other prior art circuit breaker actuators have consisted of a toggle switch like mechanism for manually engaging or disengaging the contact member thereof as exemplified in U.S. Pat. No. 2,367,382 issued July 7, 1942 to E. H. Taylor.

Other prior art patents of interest include: U.S. Pat. Nos. 4,123,737 issued Oct. 31, 1978 to Porter Hoagland, Jr.; 3,501,729 issued Mar. 17, 1970 to L. W. Brackett, Sr.; 3,213,189 issued Oct. 19, 1965 to E. B. Mitchell et al; 3,694,595 issued Sept. 26, 1972 to Stanley V. Horecky; 3,706,869 issued Dec. 19, 1972 to Richard W. Sorenson; 4,211,905 issued July 8, 1980 to Thomas J. Quigley; 4,137,602 issued Feb. 6, 1979 to Ferdinand Klumpp, Jr.; 3,168,612 issued Feb. 2, 1965 to W. T. Sorenson and 2,703,662 issued Mar. 8, 1955 to E. A. Meyer.

These patents are mentioned as being representative of the prior art and other pertinent references may exist. None of the above cited patents are deemed to affect the patentability of the present claimed invention.

For example, in contrast to the prior art, the present invention provides a circuit breaker having a simple, robust and relatively inexpensive actuator mechanism comprising a rocker button operatively associated with a slide member. The rocker button is rotatably trap mounted on a protrusion extending from the inside wall of the case and has two laterally extending axial portions which interact with pivot points on the slide member to translate the rocking motion of the rocker button into a linear motion for longitudinal translation of the slide member. The slide member includes standoff protrusions adapted to hold the operating contact surface generally out of contact with the surface of the slide member to substantially prevent contamination resulting from sliding engagement with the surface of the slide member. The rocker button may be pivoted at one end outwardly beyond the front panel so as to expose a portion of the slide member having surface characteristics, for example, color etc., contrasting with the rocker button to thereby function or serve as an indication of the tripped condition of the circuit breaker.

SUMMARY OF THE INVENTION

Generally speaking, in accordance with the invention, a circuit breaker is provided with an electrical insulator slide interposable between two contacts and a rocker button operatively associated with the insulator slide for effecting a linear motion of the insulator slide with rotation of the rocker button.

The insulator slide may include standoff protrusions adapted to slidingly engage peripheral portions of the convex contact(s) to prevent the operating contact surface thereof from deleterious rubbing engagement with the insulator slide.

The rocker button is adapted to pivot outwardly at one end so as to expose discernable indicia and/or rocker button and insulator slide portions indicative of a tripped condition.

Accordingly, an object of this invention is to provide a new and improved circuit breaker.

Another object of this invention is to provide a new and improved actuator mechanism for a circuit breaker.

A further object of this invention is to provide an actuator mechanism for a circuit breaker comprising a rocker button rotatably trap mounted within the circuit breaker and being operatively associated with an insulator slide.

A further object of this invention is to provide an insulator slide having standoffs for keeping the operating contact surface of at least one of the circuit breaker contacts off the surface of the insulator slide during resetting of the tripped circuit breaker.

A still further object of this invention is to provide an actuator mechanism adapted to visually display portions of the rocker button and insulator slide, each having a different color, as an indication of the tripped condition of the circuit breaker.

Another object of the invention is to provide an actuator mechanism for a circuit breaker wherein the slide member is within the casing, i.e., not visible, in the untripped state and has a portion which is disposed without the casing when in a tripped state.

BRIEF DESCRIPTION OF THE DRAWINGS

Other objects and advantages of the invention may be more clearly seen when viewed in conjunction with the accompanying drawings. Similar reference numerals refer to similar parts throughout.

FIG. 6 is a perspective view of the front panel and the rocker button in the closed (set) position in accordance with the invention;

FIG. 7 is a perspective view of the front panel and the rocker button in the open (tripped) position in accordance with the invention;

FIG. 10 is an exploded view of the bimetallic element sub-assembly.

DESCRIPTION OF THE PREFERRED EMBODIMENT

Figure 8B:
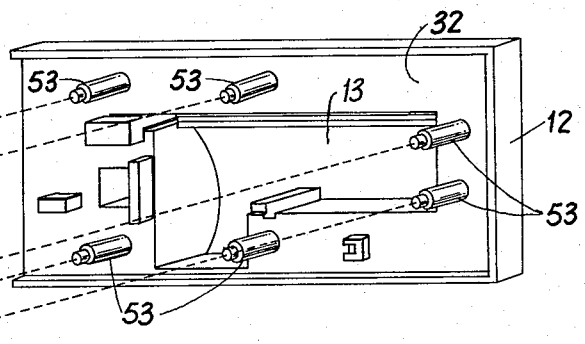
FIGS. 8A and 8B are perspective views of the two part casing of the circuit breaker in accordance with the invention.
Figure 8A:
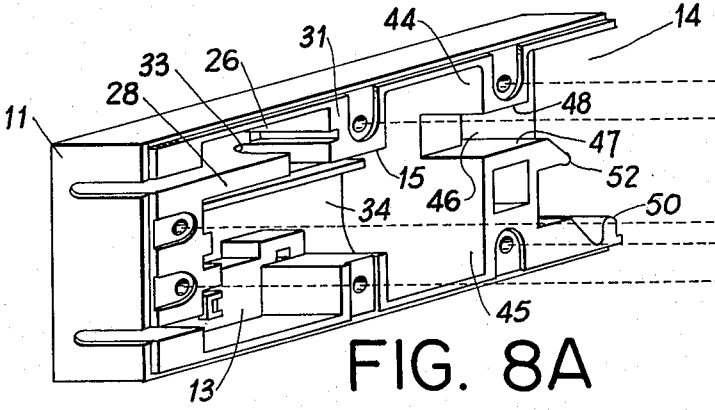

Referring to the drawings, in particular FIGS. 8A and 8B, the circuit breaker 10 includes an insulator housing, molded from an electrically insulating plastic material, having a case 11 and cover 12 therefor which cooperate to define an elongate cavity 13 and a separate cavity 14 having a first open end and a substantially closed end formed by the separating wall portions 44 and 45.

Figure 1:
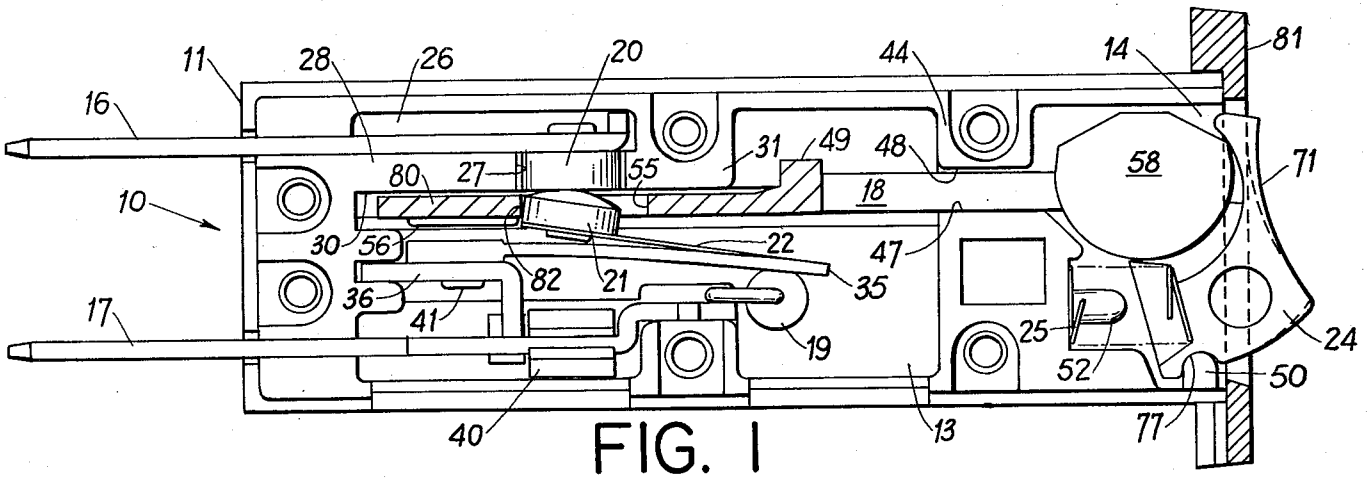
FIG. 1 is a longitudinal sectional view showing the circuit breaker in the closed (set) position.

The elongate cavity 13 is adapted to receive the contact assembly illustrated in FIG. 1.

The case 11 carries two terminals 16 and 17 (FIGS. 1 and 2) on its opposite sides, a slide member 18, a heater resistor 19, a fixed or stationary contact 20 attached to terminal 16, a movable convex shaped contact 21 attached to a tongue projecting portion 22 of a bimetallic element sub-assembly which is electrically connected to terminal 17, a rocker button 24 hinged to the slide member 18 and a spring 25 for outwardly biasing the rocker button 24 and the slide member 18. The slide member 18 and the rocker button 24 are collectively referred to as the actuating mechanism or actuator.

The stationary contact-terminal assembly 16, 20 is mounted within an alcove 26 of the housing, with terminal 16 extending without said housing and contact 20 projecting downwardly within a window or opening 27 formed between wall portions 28, 31 and 33 of case 11 and wall portion 32 of cover 12. Contact 20 is dimensioned to have a thickness which is slightly less than that of wall 28 such that its operative contact surface lies adjacent with or above the plane of the bottom wall surfaces 15, 30 and within window 27. With the circuit breaker 10 being in a fully assembled state, i.e., with cover 12 affixed to case 11, the mating wall 32 of cover 12 is held juxtaposed to wall portions 28 and 31 of case 11 thereby confining contact 20 within window 27. The back wall portion 33 of alcove 26 extends outwardly from the side wall 34 of case 11 and has a bottom surface (not shown) contiguous with the bottom wall surfaces of walls 28 and 31.

Prior to assembly (see FIG. 10), a snap acting bimetallic blade 35 is secured by means of rivit 41 to an electrically conductive support bracket 36 which has a bent trunk portion 37 mounted between arms 38 and 39 of insulator spacer 40. Terminal 17 also has a trunk portion 82 adapted to be held between arms 42 and 43 of spacer 40. Each end of the heater resistor 19 is electrically connected, e.g., welded, to a respective end of terminal 17 and bracket 36 to thereby enable a series circuit between terminal 17 and contact 21, via resistor 19.

The blade 35 projects longitudinally generally the same direction as terminals 16 and 17 and has a width which is less than the width of cavity 13 to permit it to freely flex and snap without interference.

The blade 35 includes an integral tongue 22 that carries the movable contact 21 thereon. As shown in FIG. 1, contact 21 has a generally convex or paraboloid contact surface which is spring biased into engagement with contact 20 by tongue 22 when the circuit breaker 10 is in the closed (set) position.

Figure 9:
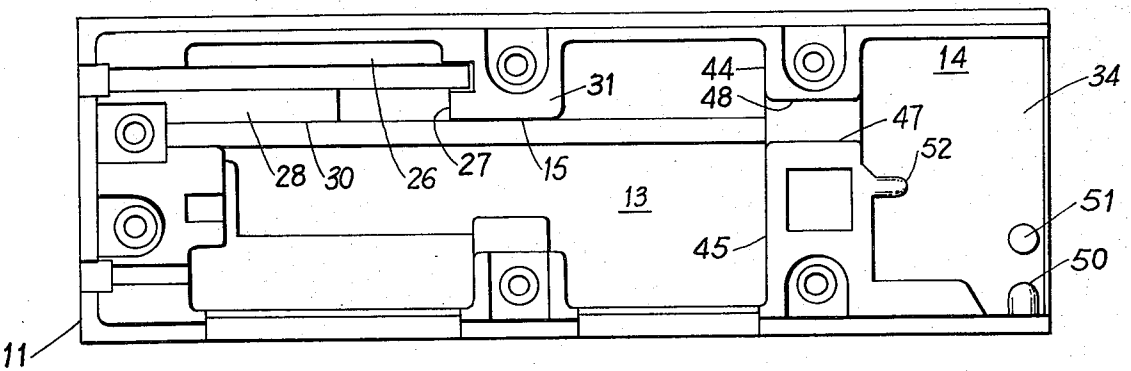
FIG. 9 is a side view of the case shown in FIG. 8A.

As noted above, the case 11 includes two partition walls 44 and 45 formed integral with wall 34 (FIGS. 8A, 8B and 9) which define a slot or passageway 46 therebetween having formed platforms or surfaces 47 and 48. The partition walls 44 and 45 divide case 11 into two compartments or cavities 13 and 14. Compartment 14 is open at its right end as viewed in FIGS. 1, 2, 8A and 9 and is adapted for rotatably trap mounting the rocker button 24 therein. A transverse projection or rib portion 50 is formed integral with the case 11 and has a curved (hub) surface portion. Spaced from the rib portion is a projecting boss or guide bar 51 which is formed integral with and is cantilevered outwardly from wall 34. A ledge portion 52 extends outwardly from wall 45 into compartment 14.

The cover 12 has formed recess and wall portions which cooperate with portions of case 11 to define the longitudinal cavities 13 and 14. Extending from cover 12 are a plurality of posts 53 which are received in formed holes in the case 11. The cover 12 may be attached to case 11 in any conventional manner such as by ultrasonic bonding.

Figure 4B:
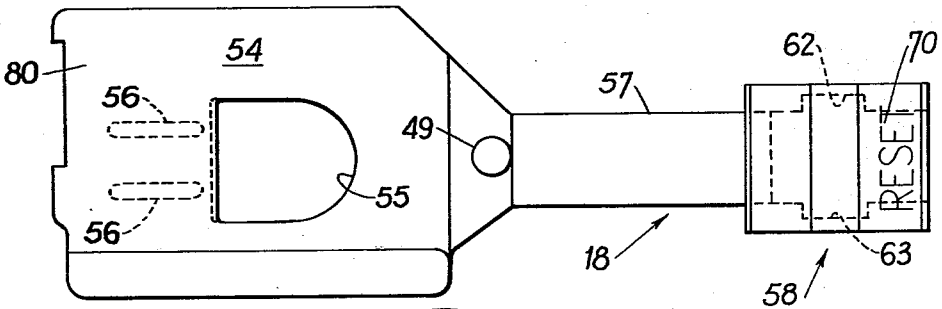
FIG. 4B is a top view of the slide member shown in FIG. 4A.
Figure 4C:
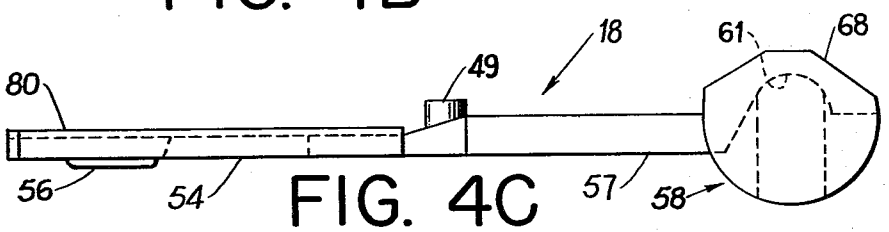
FIG. 4C is a side view of the slide member shown in FIG. 4A.
Figure 4D:
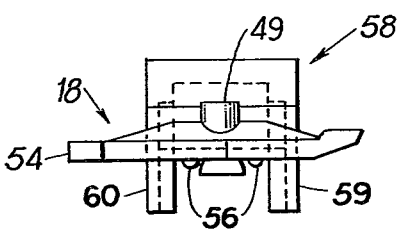
FIG. 4D is an end view of the slide member shown in FIG. 4A.
Figure 4A:
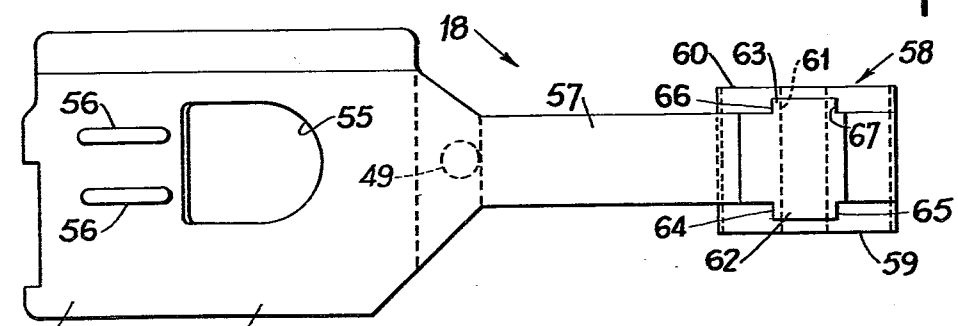
FIG. 4A is a bottom view of the slide member in accordance with the invention.

Passageway 46 is adapted to slidably receive slide member 18 therein. The slide member 18 (FIGS. 4A–D) comprises a flat and wide body portion 54 having a window or opening 55 which is slightly larger than movable contact 21, a pair of spaced parallel standoffs or contact support rails 56, a trunk portion 57, a contoured end or head portion 58 having two generally parallel downwardly projecting side walls 59 and 60, and a stop pin or abutment member 49. The head portion 58 includes an alcove or recessed portion 61. Each side wall 59 and 60 has a pivot chamber or groove 62 and 63 each defined by forward and rear abutment shoulders 65, 64 and 67, 66, respectively. The upper surface 68 of head portion 58 may be downwardly sloped so as to mate with a portion 69 of the rocker button 24 when the circuit breaker 10 is in the open (tripped) position, as will be explained more fully hereafter. Also, indicia 70 (FIG. 4B) may be provided and/or a textured or other surface characteristic such as color may be utilized to readily indicate when the circuit breaker 10 is in the open (tripped) position. As is shown in FIGS. 4B and 7, the term "RESET" may be provided in raised letters on a textured surface of head 58. The slide member 18 is made of electrical insulating material.

The rocker button 24 (FIGS. 1–3, 5A–C) is formed of electrical insulating material and integrally includes a curved outer wall surface 71, an upper sloped portion 69, support wall or arm 72 which extends inwardly from wall 71 and has a transverse axle 73 that includes two laterally projecting generally round or curved trunnions 74 and 75, a transverse groove 76 with a curved bearing (hub like) surface 77, a curved arcuate retaining guide slot 78 adapted for receiving boss 51 (FIG. 9) therein, and a ledge portion 79.

Figure 2:
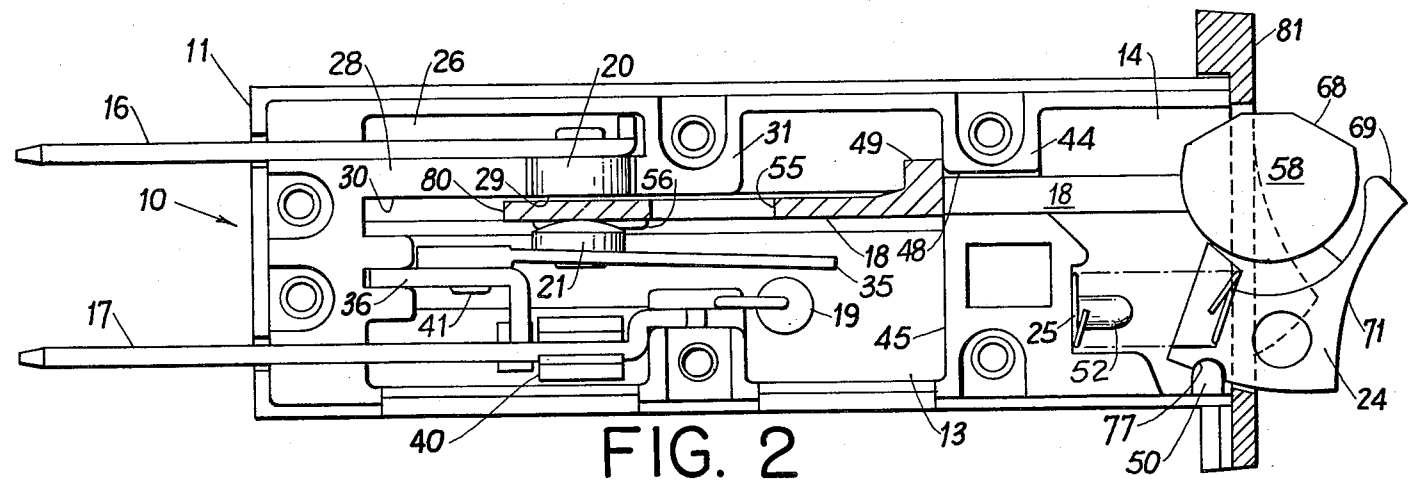
FIG. 2 is a longitudinal sectional view of the circuit breaker in FIG. 1 in the open (tripped) position.
Figure 3:
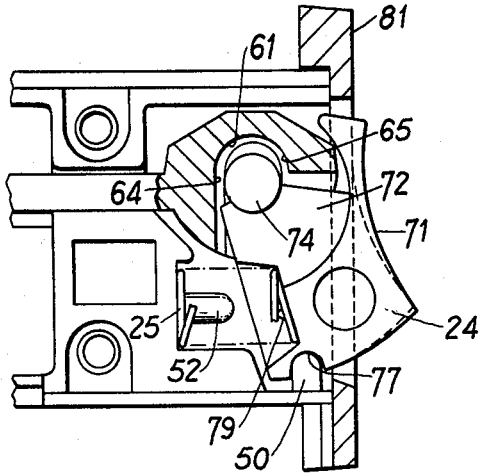
FIG. 3 is a cutaway view depicting the rocker button having laterally projecting trunnions operatively received in pivot slots formed integrally in the slide member.
Figure 5A:
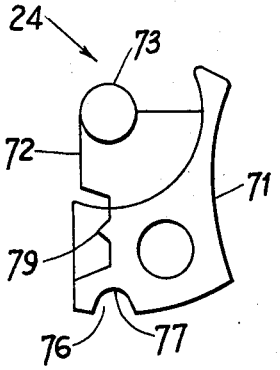
FIG. 5A is a side view of the rocker button in accordance with the invention.
Figure 5B:
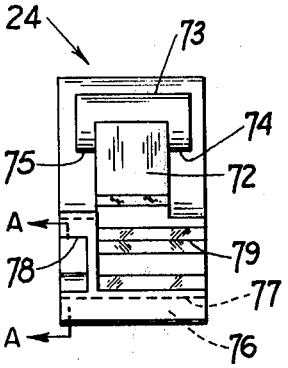
FIG. 5B is an end view of the rocker button shown in FIG. 5A.
Figure 5C:
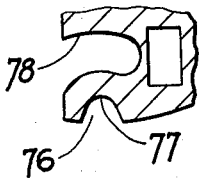
FIG. 5C is a section taken along A—A shown in FIG. 5B.

As shown in FIGS. 1–3, the assembled circuit breaker 10 (excluding cover 11) includes contacts 20 and 21 in aligned opposing disposition. The slide member 18 is slidably received between platforms 47 and 48 with its head portion 58 trap mounted to and substantially disposable within compartment 14 and its flat portion 54 adjacent surface 30 of wall 28 and interpositionable between contacts 20 and 21.

Support wall 72 is dimensioned to fit between parallel walls 59 and 60 (FIG. 4D) of the slide member 18 with axle 73 rotatably received within the head recess 61.

The trunnions 74 and 75 extend laterally each rotatably into an axially aligned channel 62 and 63 in the parallel walls 59 and 60, respectively, of the slide member 18.

The transverse rib 50 and boss 51 of case 11 are received within groove 76 and guide slot 78, respectively.

Spring 25 is trap mounted and compressed between wall 45 and rocker button 24.

With the cover 12 affixed to case 11, the rocker button 24 is trap mounted therebetween rotatably surmounted on projecting rib 50. Stop pin 49 is positioned to abut wall 44 which thereby constrains the outward travel (under influence of spring 25) of slide member 18 serving to align the insulator body portion 80 thereof with opening 27 (FIG. 2). The constrained outward travel of slide member 18 cooperates with the interlocking action of the rib 50 and boss 51 with groove 76 and guide slot 78 to trap mount the rocker button 24 to the circuit breaker housing.

A front panel 81 (FIGS. 6 and 7) may be affixed to the circuit breaker 10 to facilitate mounting thereof. The front panel 81 contains an opening through which the actuator mechanism 18, 24 can be operated.

To facilitate recognition of the condition of the circuit breaker 10, i.e., in the set or tripped position, the surface characteristics of the rocker button 24 and slide head 58 may be made visually distinguishable, for example, by different colors. Although numerous color schemes can be utilized, two preferred color combinations are shown in FIGS. 6 and 7. The slide member 18 is generally white while the rocker button 24 is depicted as being black in FIG. 6 and red in FIG. 7. Thus, in the closed (set) position only the rocker button 24 with its characteristic color is visible, but in the open (tripped) position a portion of both the rocker button 24 and slide head 58 with their visually distinguishable colors are apparent. It may also be advantageous to distinguish the front panel 81 from the rocker button 24 and/or the slide head 58 by means of a third color, for example, grey, as shown in FIG. 7, to further facilitate recognition of the set and trip condition of the circuit breaker 10.

OPERATION

With the circuit breaker 10 in the closed (set) position, the slide member 18 is positioned such that window 55 therein is aligned with opening 27 so as to permit the movable contact 21 to contact stationary contact 20, under the upwardly biased tension of tongue 22. The slide member 18 includes shoulder portion 82 which abuts with contact 21 for maintaining the circuit breaker 10 in the set state against the compressed and outwardly directed bias of helical spring 25. With a potential difference applied across terminals 16 and 17, current will flow across contacts 20 and 21. If this current exceeds a predetermined (rated) current, the heater resistor 19 will raise the temperature of the bimetallic element such that it will flex and snap causing the tongue 22 to travel downwardly and, thereby, displace the movable contact 21 below the plane of slide member 18.

With movable contact 21 disengaged from abuting with shoulder 82, spring 25, being biased against ledge 79, urges the rocker button 24 in an outward direction causing it to rotate on the bearing surface of rib 50. This outward rocking or rotational motion is translated into a linear slide motion by operation of the trunnions 74 and 75 engaging shoulders 67 and 65 of the slide head walls 60 and 59, respectively. As noted above, the outward travel of the slide 18 is constrained by stop pin 49 for defining the open (tripped) position of the circuit breaker 10 (FIG. 2).

With the circuit breaker 10 in the open (tripped) position, the series current path between terminals 16 and 17 is opened. The bimetallic element quickly dissipates heat causing it to flex and snap its tongue portion 22 in an upward direction thereby causing movable contact 21 to abut with slide standoffs 56.

The standoffs 56 are spaced apart so as to engage the generally lower peripheral portions of the convex surface of contact 21 while holding the central or apex (operative) contact surface thereof above and not in contact with slide member 18. In this manner, the operative contact surface of movable contact 21 is substantially kept clean of unwanted contamination from insulator slide material.

With the slide member 18 being urged against wall 28 and 32, under the influence of tongue 22, the passageway between opening 27 and cavity 13 is substantially or fully closed thereby effecting substantial electrical isolation of the terminal-contact sub-assembly 16, 20 from the other electrically conductive elements of the circuit breaker 10.

If the rocker button 24 is urged or pushed inwardly, trunnions 74 and 75 abut shoulders 66 and 64, respectively, urging the slide member inwardly into the closed (set) position. Contact 21 will slide on standoffs 56 until it is urged into window 55 and into electrical contact with contact 20 under the bias of tongue 22.

While there has been described herein what is considered to be the preferred embodiment(s) of the invention, other modifications may occur to those skilled in the art, and it is intended that the appended claims are to cover all such modifications which fall within the true spirit and scope of the invention as defined by the appended claims.

It is claimed:

1. A circuit breaker comprising:

a housing;

a first and a second terminal;

a stationary contact disposed within the housing being connected to said first terminal;

a movable contact disposed within said housing and connected to said second terminal;

said movable contact being moved on predetermined conditions toward and away from said stationary contact to make and break contact therewith;

an insulator slide member slidingly guided in the housing between a first and a second position and having an opening through which the movable contact being extendable to make contact with the stationary contact with said slide member being disposed in said first position, and an insulator portion interposable between said contacts and a tripped indicator portion exposable without said housing with said slide member being disposed to said second position;

said slide member also being provided with standoff means for keeping operative contact surface of said movable contact from contacting the insulator portion when slide member is in said second position;

actuator means rotatably mounted respective to said housing and engaging the slide member for translating a rotational motion of the actuator means into a linear motion displacement of the slide member; and biasing means for urging the slide member to the second longitudinal position.

2. A circuit breaker as in claim 1, wherein the movable contact has a dome shape with a generally upward swell forming the operative contact surface thereof; and the standoff means comprises two elongate projecting guide tracks integrally formed on the slide member and adapted to engage the downwardly sloped periphery of said dome shaped movable contact whereby the operative contact surface thereof is held off the insulator portion of the slide member.

3. A circuit breaker as in claim 1, wherein:

said stationary contact is disposed within an alcove integrally formed in said housing; and the insulator portion of the slide member cooperating with adjacent portions of the housing when interposed between said stationary and movable contacts to isolate said stationary contact within said alcove.

4. A circuit breaker as in claim 1, wherein:

the tripped indicator portion comprises an enlarged end portion of the slide member having a pivot groove integrally formed therein; and the actuator means comprises a rocker button rotatably trap mounted on a surface of the housing and having a trunnion extended into said pivot groove, whereby a rocking motion of the rocker button rotatably on said surface causes said trunnion to engage a portion of the pivot groove to thereby longitudinally displace said slide member.

5. A circuit breaker as in claim 1, wherein:

the tripped indicator portion of the slide member is exposed outside of said housing visually distinguishable when said actuator means is in said second position.

6. A circuit breaker as in claim 5, wherein:

said tripped indicator portion of the slide member is colored white and said rocker button having a red color;

whereby with said slide member being in the second longitudinal position, a portion of both the red colored rocker button and the white colored tripped indicator portion of the slide member are visibly exposed without said housing to indicate that the circuit breaker is in a tripped position, and with said slide member being in the first longitudinal position said tripped indicator portion thereof is disposed within said housing and out of visibility.

7. A circuit breaker as in claim 5, wherein:

said tripped indicator portion of the slide member has a generally white color;

said actuator means has a generally black color; and said white and black colors are exposed without said housing and visible to display a tripped condition of the breaker.

8. A circuit breaker as in claim 1, wherein:

said slide member includes a stop projection engaging an integral wall within said housing to define the second longitudinal position of said slide member.

9. A circuit breaker as in claim 1, including:

a bimetallic blade disposed within the interior space of the housing having the movable contact attached thereto, and movable on predetermined temperature conditions, said bimetallic blade being electrically connected to said second terminal and the movable contact.

10. A circuit breaker as in claim 1, wherein:

the housing includes a transverse rib portion and a projecting guide boss each formed adjacent the opening in the housing;

the slide member has an end portion with an alcove pivot formed therein; and the actuator means comprises a rocker button having a trunnion extended within said alcove pivot, and having a transverse groove rotatably mounted on said rib portion, and having a curved guide slot for receiving said guide boss therein;

whereby said rocker button is rotatably trap mounted at the opening of the housing to translate a rocking motion thereof into a longitudinal motion of the slide member.

11. A circuit breaker, in combination comprising:

a case of electrical insulating material having one end thereof open for access to the interior of the case, and alcove having a passageway into the interior of said case, a transverse ledge portion formed generally along a portion of of the case wall defining said open end thereof, and a tab substantially aligned with and spaced from said ledge portion;

a first terminal trap mounted within said alcove and having a portion without said case;

a stationary contact disposed within said passageway and electrically connected to said first terminal;

a second terminal mounted to said case with a terminal portion extended without said case;

a movable generally dome shaped contact electrically connected to said second terminal and being movable on predetermined conditions toward and away from said stationary contact to make and break contact therewith;

insulator slide means having a generally flat body portion with a window opening therein adapted to permit said movable contact to extend therethrough to engage said stationary contact with the slide means being disposed in a contacts closed position, and having a standoff adapted to engage an inoperative make and break contacting surface portion of said movable contact with said slide means being disposed in a contacts open position wherein the body portion thereof is interposed between the contacts to substantially close in the stationary contact with the alcove passageway of the case for isolating the stationary contact therein, and an end portion having two spaced apart generally parallel projecting wall portions each having a pivot chamber formed therein, said end portion being adapted to visibly extend a distinctive portion thereof without the open end of the case with said slide means being disposed to the contacts open position;

a rocker button actuator means rotatably trap mounted at the open end portion of the case and having axially aligned trunnions extending laterally each rotatably into one of said pivot chambers; and a helical spring compressed between a wall portion of the case and a portion of the rocker button for urging the rocker button to rotate outwardly from the case thereby displacing said slide means to the contacts open position.

12. A circuit breaker as in claim 11, wherein:

the distinctive portion of the slide means has a first visible color characteristic;

the rocker button actuator means has a portion with a second visible color characteristic;

whereby the slide means being disposed to the contacts open position the visibly distinctive colors of the slide means and rocker button actuator means serve to indicate that the circuit breaker is in a tripped condition.

13. A circuit breaker as in claim 12, wherein:

the distinctive portion of the slide means has a generally white color;

the colored portion of the rocker button is generally of a red color.

14. A circuit breaker as in claim 12, wherein:

the distinctive portion of the slide means has a generally white color;

the colored portion of the rocker button has a generally black characteristic.

* * * * *